US005843572A

United States Patent [19]

Yasuda et al.

[11] Patent Number: 5,843,572

[45] Date of Patent: Dec. 1, 1998

[54] INK JET RECORDING PAPER

[75] Inventors: Tsuyoshi Yasuda; Yoshio Yoshida; Norio Fukushima; Michiko Okamoto; Yoshihiro Kuroyama, all of Tokyo, Japan

[73] Assignee: Nippon Paper Industries Company, Ltd., Japan

[21] Appl. No.: 628,266

[22] Filed: Apr. 5, 1996

[30] Foreign Application Priority Data

Apr. 7, 1995 [JP] Japan ..... 7-107995
Apr. 14, 1995 [JP] Japan ..... 7-113827

[51] Int. Cl.[6] ..... B41M 5/00

[52] U.S. Cl. ..... 428/342; 428/195; 428/211; 428/520; 428/537.5

[58] Field of Search ..... 428/195, 211, 428/520, 537.5, 342

[56] References Cited

U.S. PATENT DOCUMENTS 4,900,620 2/1990 Tokita et al. ..... 428/195
5,328,504 7/1994 Ohnishi ..... 106/20 D
5,354,369 10/1994 Shimomura et al. ..... 106/20 D

FOREIGN PATENT DOCUMENTS

0600245A1 6/1994 European Pat. Off. ..... B41M 5/00
0602400A1 6/1994 European Pat. Off. ..... B41M 5/00
2211866 7/1989 United Kingdom ..... D21H 3/78

*Primary Examiner*—Pamela R. Schwartz
*Attorney, Agent, or Firm*—Millen, White, Zelano & Branigan, P.C.

[57] ABSTRACT

Provided is an ink jet recording paper having an ink receiving layer comprising a high absorption pigment and a binder provided on at least one side of a base paper comprising wood pulp and a filler, with the ink receiving layer having a coverage rate of from 0.5 to 5.0 g/m$^2$ per side of the base paper and a contact angle of from 80 to 100 degrees measured using a liquid having a surface tension of 40 dyne/cm.

9 Claims, 1 Drawing Sheet

INK JET RECORDING PAPER

FIELD OF THE INVENTION

This invention relates to an ink jet recording paper, and more particularly, to an economical ink jet recording paper having the texture of ordinary paper which ensures not only high printing qualities and high optical density in printed characters, ruled lines and fully printed part, but also excellent uniformity of optical density in fully printed parts, when printing with an ink jet color printer.

BACKGROUND OF THE INVENTION

Ink jet recording offers the advantages of high speed, low noise and easy adaptability to color printing, and high quality images close to those obtained by typography or photography can produced by very low cost color ink jet printers. For these reasons, the technique has rapidly become popular in recent years. Economical, high precision ink jet heads are widely used also in copying machines, word processors and facsimile machines.

Due to the generalization of these low cost color ink jet printers, color information can now easily be added to text in offices and homes which formerly used mainly black-and-white printers. Thus, the paper used therein (offices and homes) must now be endowed with the characteristics of color ink jet printer paper in addition to those of black-and-white ink jet printer paper.

Further, if this paper is to be used as ordinary office paper, it is required to have the texture of ordinary paper so that it can easily be written on with a pencil and handled, as in the case of PPC paper.

In the case of monochrome printers, most of the printed material comprises characters and tables, and since characters and ruled lines have to be clear, low feathering is an important requirement. Feathering is the loss of clarity of characters and ruled lines when ink spreads horizontally so that dots become blurred, and whiskering along fibers in the paper. When feathering is severe, it becomes difficult to recognize the shapes of intricate Chinese characters.

To resolve this problem of feathering, the sizing properties of the paper as a whole must be enhanced by increasing the amount of internal sizing agent in the base paper or the amount of sizing agent added to the ink receiving layer so as to decrease the wetting of the paper by the ink. However if sizing properties are excessively increased, the ink does not penetrate the paper layers and remains on the surface, therefore when touched by other printer parts or by the hands, or when the next page is printed and superposed on it, smudging occurs.

To avoid this, the ink drops must rapidly penetrate the paper layers so that they effectively become dry. The ability of the ink to penetrate the paper is thus referred to as ink drying properties, so to improve ink drying properties, sizing properties must be de-emphasized. Feathering and ink drying properties are consequently in a trade-off relationship with one another, and the question of deciding at which point sizing properties should be set to achieve a good balance is an important problem in the design of an ink jet recording paper.

In black-and-white printing, as in the case of color printing, optical density of the image must be increased so that characters are clearly recognized, but with color prints there are many half tone or fully printed parts such as graphs, diagrams or pictures, so it is even more important to increase dot density or increase the optical density of fully printed parts.

In color ink jet printer recording papers, an ink receiving layer was generally provided which mainly comprised a highly absorbing pigment such as silica together with a binder (e.g. Tokkai Sho 55-51583 Koho, Tokkai Sho 62-158084 Koho, Tokkai Hei 5-96844 Koho).

In color ink jet printing, as in the case of other color image reproduction techniques, all colors are reproduced with 3 or 4 colors, so inks of up to 4 colors may be printed at the same place on the paper. This part where inks of various colors are superposed is known as a mixed color part, and as the ink amount in this part is 2–4 times greater than that in single color parts, high ink absorption capacity is naturally required.

Further, when a different color ink is printed before an ink of a first color which has already been printed is absorbed, the inks flow into each other at the print boundaries and cause smearing (this is referred to as bleeding). To prevent this bleeding, color ink jet printing paper must have an even higher ink absorption capacity and speed compared to black-and-white recording paper. The ink jet recording paper may be an uncoated type paper which has not been coated with a pigment coating, a slightly coated type paper provided with an ink receiving layer to the extent of 0.5–5 $g/m^2$, a lightly coated type paper of approx. 10 $g/m^2$, or a heavily coated type paper of approx. 20 $g/m^2$. In the case of the lightly and heavily coated types, the coated layer is damaged when it is written on by a pencil, because the hardness thereof is less than that of the lead of a pencil, and the paper is inferior in stiffness; as a result, handling is difficult and the paper lacks the texture of ordinary paper.

On the other hand, in the case of an uncoated type paper to which a pigment coating had not been applied, it was difficult to obtain a sufficiently high optical density of image to enable it to be used as a color ink jet recording paper.

In recent years, many slighty coated type papers have been proposed for use as color ink jet recording papers having the texture of ordinary paper. Tokkai Hei 6-312572 Koho for example discloses a recording paper wherein at least 70% of the surface of the pulp fibers in the base paper is covered with superfine particles of an inorganic pigment, and Tokkai Hei 6-155893 Koho discloses a recording paper comprising an ink receiving layer on the surface having a larger base paper pigment surface area ratio (proportion of surface area of pigment contained in each part when a section of the base paper is equivalently divided into a upper surface part and a lower surface part). Normally, this is the upper surface.

However, if at least 70% of the pulp fibers are covered using a small amount of coating material as disclosed in Tokkai Hei 6-312572 Koho, a superfine pigment, e.g. a costly pigment such as colloidal silica, must be used. This increases cost, and it was also difficult to obtain satisfactory ink absorption properties at 5 $g/m^2$ or less even using this type of pigment.

If an ink receiving layer is provided on the surface having a higher retention of internal filler (the surface containing a greater amount of internal filler when a section of the base paper is equivalently divided into an upper surface part and a lower surface part), as disclosed in Tokkai Hei 6-155893 Koho the internal filler optically obscures the ink absorbed in the paper layers although good ink absorption properties may be obtained, hence image density falls as in the case when the amount of filler in the raw paper is increased (Tokkai Hei 6-143796 Koho).

In other words, in the case of a slightly coated recording paper wherein the amount of ink receiving layer is 5 $g/m^2$ or less, the ink cannot be completely absorbed by the ink absorbing layer alone. Ink must therefore be absorbed also by the raw paper layer, however when ink absorption properties are enhanced by increasing the amount of internal filler so as to increase the void in the raw paper, the ink absorbed in the paper layers is optically obscured by the filler, and this causes a decline of the optical density of image.

Further, deterioration due to feathering as described hereinabove cannot be avoided merely by using a raw paper of low sizing degree (e.g. Tokkai Sho 52-5301 Koho).

A coating of a water-soluble polymer may be provided as an ink receiving layer (Tokkai Sho 55-144172 Koho and Tokkai Sho 55-146786 Koho), however sufficient ink absorption capacity cannot be obtained using this method.

In addition to the development of these recording papers, it has been attempted to resolve these problems by lowering the surface tension of the ink in order to improve absorption in the paper (Tokkai Sho 59-20366 Koho and Tokkai Hei 3-41171 Koho). As a result of these attempts, inks having a surface tension lying in the range of 30–45 dyne/cm are now usually used instead of ink having a surface tension of approx. 50 dyne/cm which was formerly used in ink jet printers. However, even in this case, it is difficult to resolve both the problem of feathering and that of ink absorption using a slightly coated type ink jet recording paper having the texture of ordinary paper, and some way of improving the paper is still necessary.

An economical recording paper having the texture of ordinary paper was therefore needed to supply demand created by the popularity of economical color ink jet printers. Recently, during the course of tests carried out mainly with slightly coated type paper, this type of paper was found to have an additional disadvantage in that white spots appeared in fully printed parts.

These white spots are due to the fact that with ink jet recording papers having exposed pulp fibers on their surface, as in the case of an uncoated type paper or slightly coated type paper, attachment of ink to paper in fully printed parts of the paper is poor. The white spots are scattered over these fully printed parts, some of the larger ones reaching a diameter of 1–2 mm.

As a result of intensive studies aimed at overcoming the aforesaid problems, the inventors found that by adjusting the proportion of spaces in the wood pulp used to make the base paper, an ink jet recording paper can be manufactured which offers excellent image reproduction, not only of characters but also of color images, and which has the texture of ordinary paper. White spots become more evident the more the amount of sizing agent is increased in an effort to decrease feathering, however the inventors found that by improving ink absorption, the problem of white spots is alleviated. Finally, the inventors found that by using polyvinyl alcohol having a low degree of polymerization as binder in the slight coating layer, white spots are decreased while maintaining feathering at a low level.

SUMMARY OF THE INVENTION

It is therefore a first object of the invention to provide an economical, slightly coated type ink jet recording paper which has the texture of ordinary paper from the viewpoint of writing with a pencil and handling, which gives little smudging of characters or ruled lines, and which offers excellent character quality and color image reproduction.

It is a second object of the invention to provide an ink jet recording paper having the texture of ordinary paper from the viewpoints of writing with a pencil and handling, which gives little smudging of characters and ruled lines, and which is highly suitable (ink absorption and optical density of image) for printing with a color ink jet printer.

It is a third object of the invention to provide a slightly coated type ink jet recording paper which prevents the appearance of white spots in fully printed parts, and which offers high quality image reproduction by color ink jet recording.

The aforesaid objects of the invention are attained by an ink jet recording paper having an ink receiving layer comprising a high absorption pigment and binder as its principal components provided on at least one surface of a base paper comprising mainly wood pulp and a filler, the amount of this layer lying in the range of 0.5–5.0 g/m$^2$ on each surface to which the layer is applied, and the contact angle of the ink receiving layer lying in the range of 80–100 degrees measured using a liquid having a surface tension of. 40 dyne/cm.

DETAILED DESCRIPTION OF THE INVENTION

Figure 1:
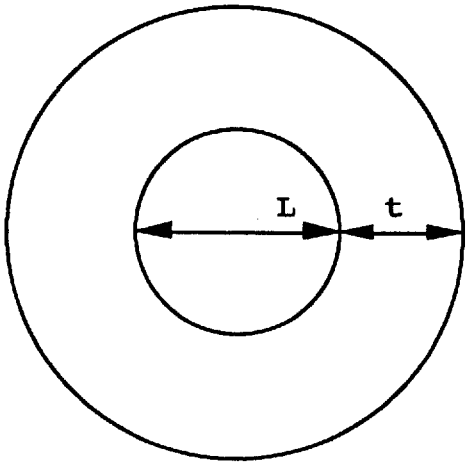
FIG. 1 is a schematic diagram showing the cross-sectional shape of a pulp fiber for the purpose of describing Runkel ratio. The symbol L in the figure denotes the width of a fiber lumen (internal cavity), and t denotes the thickness of a fiber cell wall.

The ink jet recording paper of this invention will now be described in further detail.

The wood pulp raw material used in this invention may be chosen from L-BKP, N-BKP, recycled pulp and machanical pulp, whichever may be appropriate, however as the fibers of N-BKP are thicker and longer than those of L-BKP, they tend to cause feathering which reduces image quality. On the other hand, machanical pulp tends to affects the paper texture so that it is not like ordinary paper. It is therefore desirable that at least 70% of the pulp fiber, and particularly desirable that at least 75% of the pulp fiber is L-BKP. Moreover, it is desirable that the proportion of L-BKP having a Runkel Ratio of from 1.0 to 3.0 to the total pulp be at least 20%, preferably at least 25%, The Runkel ratio is an indicator that specifies the shape of a pulp fiber. As shown in FIG. 1, this ratio is determined from the width L of a fiber lumen (internal cavity) and the thickness t of a cell wall, and is expressed by R=2.t/L. The Runkel ratio may be determined according to the method described in "Morphology of Wood Fibers and Properties of Paper" by Masao Moriya, on page 20, No. 3, Vol. 21 of "Kami Pulp Gijutsu Kyokaishi" (Japan TAPPI Journal).

(Sampling) A log is cut along a section to obtain a disk, and 6 cubic blocks having a volume of 1 cm$^3$ were cut out from the disk in the outward direction from the pith.

(Treatment) Each of these blocks was boiled thoroughly in water, and immersed in a softening solution constituted of acetic acid, hydrogen peroxide and water (15:20:20) for several days. Each of the thus softened blocks is rinsed with water, and embedded in paraffin. Therefrom, traverse slices in a thickness of about 16 $\mu$ are prepared. In order to remove the paraffin, the slices are soaked in ethanol, and further in xylene. The thus treated slices are dyed with Malachite Green, and sealed with Canada balsam to make prepared specimens for microscopic observation. These specimens are examined with a microscope of 500 magnifications and the photographs thereof are taken. From those all microphotographs, 1,000 fibers are chosen arbitrarily, and examined for fiber width (D) and lumen width (l) which each fiber has in the direction of cut line.

The fiber width and the lumen width are defined as the average of the thus measured values of D and l respectively.

Since the aforementioned treatment uses ethanol and xylene as a penetrating agent, the fiber width and the lumen width determined are thought to undergo only slight influence of swelling or shrinkage due to the treatment.

When paper is made using pulp fibers having a high Runkel ratio, a porous paper is obtained wherein the fiber bonding area is small, and ink absorption properties are enhanced.

When the Runkel ratio is too high, however, as the fiber bonding area becomes very small, the strength and stiffness of the paper decrease, the texture of ordinary paper is lost, and since surface properties decline, the suitability of the paper for printing is also impaired.

Pulp is generally beaten before papermaking, but if the pulp is beaten too much, fiber bonding is promoted so that the paper becomes dense. This tends to nullify the effect of this invention which is due to the use of pulp fibers having a higher Runkel ratio than that of the fibers which are usually used. According to this invention, the pulp is not beaten too much, and it is desirable to set the freeness to a high value, i.e. 450–600 ml C.S.F. or more particularly 500–600 ml C.S.F.

As described hereintofore, by arranging the amount of L-BKP having a Runkel ratio lying in the range of 1.0–3.0 to be at least 20% of the total pulp, and if necessary maintaining a high freeness, satisfactory ink absorption properties can be obtained without any worsening of feathering. In this case also however, when the contact angle is greater than 100 degrees for an ink having a surface tension of 40 dyne/cm on the recording paper surface, ink absorption properties are unsatisfactory.

To reduce feathering, the aforesaid contact angle must be at least 80 degrees, and is preferably at least 85 degrees. This contact angle is a value measured according to TAPPI standard T458 om-84. However, to evaluate wettability with ink having a surface tension lying in the range of 30–45 dyne/cm, a liquid having a surface tension of 40 dyne/cm must be used as a reagent. In this case, as there is a large variation of contact angle due to absorption of liquid, the measurement time must be within 0.1 seconds from when the liquid is dropped on the paper.

The aforesaid contact angle is adjusted by adding fillers or sizing agents to the base paper. Although internal fillers improve ink absorption properties, an excessive quantity causes opacity and a decline of image density as described hereinabove. It is therefore preferable that the amount of filler is no greater than 10 weight parts per 100 weight parts of pulp fiber. The filler may be chosen from any of those known in the art such as calcium carbonate, talc or kaolin.

The internal sizing agent must be adjusted together with the (externally added) sizing agent in the ink receiving layer such that the contact angle for a liquid having a surface tension of 40 dyne/cm lies within the range of 80–100 degrees. From the viewpoints of coating properties and permeability of the coating solution, however, the St öckigt sizing degree of the raw paper is preferably adjusted so that it is at least 5 seconds. The internal sizing agent used in this invention may be any acidic or neutral sizing agent, however from the viewpoint of color reproducing properties, the use of a neutral sizing agent such as AKD, ASA or neutral rosin is preferable. In this invention, other internal reagents such as paper reinforcing agents may also be used as appropriate.

In the ink receiving layer which is applied to at least one surface of the base paper, various white pigments known in the art such as kaolin and calcium carbonate may be used in conjunction, however, the principal component must be a pigment having high absorption properties such as synthetic silica or synthetic alumina in order to obtain a high image density. The specific surface area of this pigment having high absorption properties is at least 100 $cm^2/g$ measured by the BET method, and its use leads to the formation of large numbers of cavities in the coating layer when the coating is applied.

The binder used in the ink receiving layer may comprise various denatured starches or latexes, however from the viewpoint of image clarity, it is preferable that polyvinyl alcohol (PVA) is used as the principal component. In this context, the meaning of principal component is that PVA should account for at least 70% of the total amount of binder.

When this PVA has a high degree of polymerization, white spots tend to appear in fully printed parts. It is therefore desirable to use a PVA of which the degree of polymerization lies within the range of 300–1,000. According to this invention, this PVA preferably accounts for 50–100% of the total PVA.

When the polymerization degree is less than 300, the PVA does not have much effect as a binder on the pigment, thereby leading to falling of powder. Concerning the pigment and binder is used in the ink receiving layer of this invention, it is preferable that the amount of binder lies within the range of 5–25 weight parts relative to 100 weight parts of the aforesaid high absorption pigment. When the amount of binder is less than 5 weight parts, falling of powder occurs. On the other hand when the amount exceeds 25 weight parts, the binder enters spaces into which ink should be absorbed, thereby decreasing ink absorption properties and increasing the formation of white spots.

According to this invention, from the viewpoints of obtaining a high optical density of image with a color ink jet printer and providing a recording paper having the texture of: ordinary paper, the coating amount of the ink receiving layer should lie within the range of 0.5–5.0 $g/m^2$ on each surface to which the coating is applied. When the amount is less than 0.5 $g/m^2$, a satisfactory optical density of image is not obtained, and when the amount exceeds 5.0 $g/m^2$, the texture of ordinary paper is lost as it is no longer suitable for writing with a pencil and it feels different to the touch.

When the ink receiving layer is applied to one surface of the paper, a one-sided recording paper is obtained, and when it is applied to both surfaces, a double-sided recording paper is obtained upon which images of substantially the same quality can be recorded.

In order to apply the ink receiving layer, an air knife coater, bar coater or various blade coaters can be used. However, it is preferable to employ a method which applies the coating solution to the paper layers at high pressure during the coating process, such as a size press or gate roll. As a size press or gate roll is provided as part of papermaking machinery, the use of these instruments for coating has an advantage in that the coating process can be performed on-line. Further, a size press and a gate roll can offer another advantage that, as in the present invention, even when the amount of binder is largely reduced in comparison to the conventional amount (30 weight parts or more relative to 100 weight parts of pigment), they can prevent a decrease of surface strength of the recording paper or falling of powder.

In the ink jet recording paper according to this invention, at least 20% of the wood pulp used is L-BKP having a Runkel ratio lying in the range of 1.0–3.0, so feathering is within tolerance and ink absorption is good. Further, by properly choosing a coverage of the ink receiving layer, high optical density can be ensured in the recorded images as the texture of the recording paper is much like that of ordinary paper, namely recorded images of a satisfactorily high quality can be obtained, even in color ink jet recording.

Still further in the ink jet recording paper according to this invention, in addition to the fact that the amount of binder in the ink receiving layer is low, it is comprised mainly of PVA having a low degree of polymerization, and the contact angle of the recording paper surface is adjusted to within suitable limits. Ink absorption is therefore good, and white spots do not appear in fully printed parts.

EXAMPLE

The present invention will now be illustrated in more detail by reference to the following examples. However, the invention should not be construed as being limited to these examples. Unless otherwise noted, all "%" and all "parts" in the examples and comparative examples are by weight.

Additionally, the tests made in the examples and comparative examples and evaluation criteria adopted therein are described below.

(1) Contact Angle: A wetting index standard solution No. 4 (which has surface tension of 40 dyne/cm, and is a product of Wako Junyaku Kogyo Co., Ltd.) is used as a solution for measuring a contact angle on a paper to be tested. At the point of a 0.1-second lapse after dropping the solution onto the paper, the contact angle for the solution is measured with an automatic contact-angle tester, Model CA-Z (made by Kyowa Kaimen Kagaku-Sha).

(2) Optical Densities of Recorded Images: A prescribed pattern is recorded with an ink jet recording apparatus, DeskJet 505J (trade name, a product of HEWLETT PACKARD), and the optical densities of black solid areas are measured with a Macbeth densitometer RD514.

(3) Feathering: A prescribed pattern is recorded with an ink jet recording apparatus made by HEWLETT PACKARD, a DeskJet 505J (trade name), and the spread of ink in a whisker shape along ruled lines (or the feathering of ink) is evaluated by visual observation in accordance with the following criterion;

O No feathering of ink is observed.

Δ L Some feathering of ink is observed.

X Severe feathering of ink is observed.

(4) White Spots in Solid Printed Area: A prescribed pattern is printed with an ink jet recording apparatus made by HEWLETT PACKARD, a DeskJet 505J (trade name), and the solid printed area of cyan is examined by visual observation whether or not white spots are present therein. The evaluation criterion is as follows:

O No white spots is observed.

Δ Some white spots are observed.

X Many white spots are observed.

(5) Bleeding: A prescribed pattern is printed with an ink jet recording apparatus made by HEWLETT PACKARD, a DeskJet 505J (trade name). The boundary between a red area (an area of magenta-yellow mixture) and a green area (an area of cyan-yellow mixture) in the printed pattern is observed through a microscope, and thereby the width of bleeding at the boundary is determined. If the width is not greater than 200 μm, the bleeding is regarded as satisfactory.

(6) Drying Time of Ink: A prescribed pattern is printed with an ink jet recording apparatus made by HEWLETT PACKARD, a DeskJet 505J (trade name), and the time by which the printed area is apparently dried and no stain is generated by rubbing it with fingers is measured.

Example 1

A paper stock prepared by adding ground calcium carbonate, 1.0 part of aluminum sulfate, 1 part of cationized starch, 0.1 part of a sizing agent (alkylketene dimer) and 0.02 part of a retention aid to pulp slurry constituted of 80 parts of L-BKP (Runkel ratio: 0.66) having a freeness of 420 ml (based on C.S.F) and 20 parts of N-BKP having a freeness of 480 ml (based on C.S.F) was made into paper by means of a Fourdrinier paper machine so that the resulting paper had a basis weight of 78 g/m$^2$ and a filler content of 5.8% Then, the thus made paper was coated on both sides with the following coating composition I by means of a size press. The recording paper thus obtained was examined by the aforementioned testing methods (1) to (5). The testing results and the amount of solids coated per side (per side coverage) are shown in Table 1.

| Coating Composition I: | |
|---|---|
| Synthetic silica [Finesil, trade name, a product of Tokuyama Soda Co. Ltd.] | 100 parts |
| Binder [PVA 105 (trade name, a product of Kuraray Co., Ltd.), polymerization degree: 500] | 15 parts |
| Sizing agent [Basoplast 250D, trade name, a product of Basof Co., Ltd.] | 10 parts |
| Anti-foaming agent [Foamaster AP, trade name, a product of San Nopco Co., Ltd.] | 0.05 part |

Example 2

From the same paper stock as prepared in Example 1, a paper was made so as to have a basis weight of 78 g/m$^2$ and a filler content of 7.5%. The paper thus made was coated on both sides with the following coating composition II by means of a gate roll coater. The recording paper thus obtained was examined by the aforementioned testing methods (1) to (5). The testing results and the amount of solids coated per side (per side coverage) are shown in Table 1.

| Coating Composition II: | |
|---|---|
| Synthetic silica [Mizukasil, trade name, a product of Mizusawa Kagaku Co. Ltd.] | 100 parts |
| Binder [PVA 103 (trade name, a product of Kuraray Co., Ltd.), polymerization degree: 300] | 30 parts |
| Water retention agent [Sunrose A 01MC, trade made a product of Nippon Paper Industries Co., Ltd.] | 5 parts |
| Sizing agent [NC Size C-40, trade name, a product of Nikka Kagaku Co., Ltd.] | 12 parts |
| Anti-foaming agent [Foamaster AP, trade name, a product of San Nopco Co., Ltd.] | 0.05 part |

Example 3

Paper stock was prepared in the same manner as in Example 1, except that the pulp slurry used therein was replaced by L-BKP pulp slurry (Runkel ratio: 0.78) having a freeness of 450 ml, and therefrom a paper was made so as to have a basis weight of 125 g/m$^2$ and a filler content of 3.2%. Then, the thus made paper was coated on both sides with the following coating composition III by means of a size press. The recording paper thus obtained was examined by the aforementioned testing methods (1) to (5). The testing results and the amount of solids coated per side (per side coverage) are shown in Table 1.

| Coating Composition III: | |
|---|---|
| Synthetic silica [Aerozil, trade name, a product of Nippon Aerozil Co. Ltd.] | 100 parts |
| Binder [PVA 110 (trade name, a product of Kuraray Co., Ltd.), polymerization degree: 1000] | 10 parts |
| Sizing agent [BLS-720, trade name, a product of Misawa Ceramics Co., Ltd.] | 10 parts |
| Anti-foaming agent [Foamaster AP, trade name, a product of San Nopco Co., Ltd.] | 0.05 part |

Example 4

A paper stock was prepared by adding the same internal additives in the same respective amounts as in Example 1 to pulp slurry obtained by mixing 35 parts of L-BKP having a Runkel ratio of 2.35 and 65 parts of L-BKP having a Runkel ratio of 0.66 and beating them so that the freeness of the resulting pulp slurry was 500 ml, and then made into paper by means of a Fourdrinier paper machine so that the paper had a basis weight of 80 g/m$^2$ and a filler content of 4.7% Then, the thus made paper was coated on both sides with the foregoing coating composition I by means of a size press. The recording paper thus obtained was examined by the aforementioned testing methods (1) to (5). The testing results and the amount of solids coated per side (per side coverage) are shown in Table 1.

Example 5

Paper was made from the same paper stock as used in Example 1 so as to have a basis weight of 79 g/m2 and a filler content of 4.7%, and then coated on both sides with the following coating composition IV by means of a size press. The recording paper thus obtained was examined by the aforementioned testing methods (1) to (5). The testing results and the amount of solids coated per side (per side coverage) are shown in Table 1.

| Coating Composition IV: | |
|---|---|
| Synthetic silica [Aerozil, trade name, a product of Nippon Aerozil Co. Ltd.] | 100 parts |
| Binder: | |
| [PVA 105 (trade name, a product of Kuraray Co., Ltd.), polymerization degree: 500] | 15 parts |
| [SK-3000 (trade name, a product of Nippon Cone starch Co., Ltd.), starch esterified with phosphoric acid] | 3 parts |
| Sizing agent [BLS-720, trade name, a product of Misawa Ceramics Co., Ltd.] | 10 parts |
| Anti-foaming agent [Foamaster AP, trade name, a product of San Nopco Co., Ltd.] | 0.05 part |

Example 6

Paper was made from the same paper stock as used in Example 1 so as to have a basis weight of 79 g/m2 and a filler content of 4.7%, and then coated on both sides with the following coating composition V by means of a size press. The recording paper thus obtained was examined by the aforementioned testing methods (1) to (5). The testing results and the amount of solids coated per side (per side coverage) are shown in Table 1.

| Coating Composition V: | |
|---|---|
| Synthetic silica [Aerozil, trade name, a product of Nippon Aerozil Co. Ltd.] | 100 parts |
| Binder: | |
| [PVA 103 (trade name, a product of Kuraray Co., Ltd.), polymerization degree: 300] | 15 parts |
| [PVA 117 (trade name, a product of Kuraray Co., Ltd.), polymerization degree: 1700] | 5 parts |
| Sizing agent [BLS-720, trade name, a product of Misawa Ceramics Co., Ltd.] | 10 parts |
| Anti-foaming agent [Foamaster AP, trade name, a product of San Nopco Co., Ltd.] | 0.05 part |

Comparative Example 1

Paper was made from the same paper stock as used in Example 1 so as to have a basis weight of 78 g/m2 and a filler content of 5.5%, and then coated on both sides with the following coating composition VI by means of a size press. The recording paper thus obtained was examined by the aforementioned testing methods (1) to (5). The testing results and the amount of solids coated per side (per side coverage) are shown in Table 1.

| Coating Composition VI: | |
|---|---|
| Synthetic silica [Finesil, trade name, a product of Tokuyama Soda Co. Ltd.] | 100 parts |
| Binder [PVA 117 (trade name, a product of Kuraray Co., Ltd.), polymerization degree: 1700] | 15 parts |
| Sizing agent [Basoplast 250D, trade name, a product of Basof Co., Ltd.] | 10 parts |
| Anti-foaming agent [Foamaster AP, trade name, a product of San Nopco Co., Ltd.] | 0.05 part |

Comparative Example 2

Paper was made from the same paper stock as used in Example 1 so as to have a basis weight of 61 g/m2 and a filler content of 7.5 %, and then coated on both sides with the following coating composition VII by means of a gate roll coater. The recording paper thus obtained was examined by the aforementioned testing methods (1) to (5). The testing results and the amount of solids coated per side (per side coverage) are shown in Table 1.

| Coating composition VII: | |
|---|---|
| Synthetic silica [Mizukasil, trade name, a product of Mizusawa Kagaku Co. Ltd.] | 100 parts |
| Binder [PVA 120 (trade name, a product of Kuraray Co., Ltd.), polymerization degree: 2000] | 15 parts |
| Water retention agent [Sunrose A 01MC, trade made a product to Nippon Paper Industries Co., Ltd.] | 5 parts |
| Sizing agent [NC Size C-40, trade name, a product of Nikka Kagaku Co., Ltd.] | 12 parts |
| Anti-foaming agent [Foamaster AP, trade name, a product of San Nopco Co., Ltd.] | 0.05 part |

Comparative Example 3

Paper was made from the same paper stock as used in Example 3 so as to have a basis weight of 125 g/m2 and a filler content of 3.3%, and then coated on both sides with the following coating composition VIII by means of a size press. The recording paper thus obtained was examined by the aforementioned testing methods (1) to (5). The testing results and the amount of solids coated per side (per side coverage) are shown in Table 1.

| Coating Composition VIII: | |
|---|---|
| Synthetic silica [Aerozil, trade name, a product of Nippon Aerozil Co. Ltd] | 100 parts |
| Binder [PVA 103 (trade name, a product of Kuraray Co., Ltd.), polymerization degree: 300] | 30 parts |
| Anti-foaming agent [Foamaster AP, trade name, a product of San Nopco Co., Ltd.] | 0.05 part |

Comparative Example 4

Paper was made from the same paper stock as used in Example 1 so as to have a basis weight of 79 g/m2 and a filler content of 4.7%, and then coated on both sides with the following coating composition IX by means of a size press. The recording paper thus obtained was examined by the aforementioned testing methods (1) to (5). The testing results and the amount of solids coated per side (per side coverage) are shown in Table 1.

| Coating Composition IX: | |
|---|---|
| Synthetic silica [Finesil, trade name, a product of Tokuyama Soda Co. Ltd.] | 100 parts |
| Binder: | |
| [PVA 105 (trade name, a product of Kuraray Co., Ltd.), polymerization degree: 500] | 10 parts |
| [SK-3000 (trade name, a product of Nippon Cone starch Co., Ltd.), starch esterified with phosphoric acid] | 10 parts |
| Sizing agent [Basoplast 250D, trade name, a product of Basof Co., Ltd.] | 10 parts |
| Anti-foaming agent [Foamaster AP, trade name, a product of San Nopco Co., Ltd.] | 0.05 part |

Comparative Example 5

Paper was made from the same paper stock as used in Example 1 so as to have a basis weight of 79 g/m2 and a filler content of 4.7%, and then coated on both sides with the following coating composition X by means of a size press. The recording paper thus obtained was examined by the aforementioned testing methods (1) to (5). The testing results and the amount of solids coated per side (per side coverage) are shown in Table 1.

| Coating Composition X: | |
|---|---|
| Synthetic silica [Finesil, trade name, a product of Tokuyama Soda Co. Ltd.] | 100 parts |
| Binder | |
| [PVA 105 (trade name, a product of Kuraray Co., Ltd.), polymerization degree: 500] | 5 parts |
| [PVA 117 (trade name, a product of Kuraray Co., Ltd.), polymerization degree: 1700] | 10 parts |
| Sizing agent [Basoplast 250D, trade name, a product of Basof Co., Ltd.] | 10 parts |
| Anti-foaming agent [Foamaster AP, trade name, a product of San Nopco Co., Ltd.] | 0.05 part |

Comparative Example 6

Paper was made from the same paper stock as used in Example 1 so as to have a basis weight of 79 g/m2 and a filler content of 4.7%, and then coated on both sides with the following coating composition XI by means of a size press. The recording paper thus obtained was examined by the aforementioned testing methods (1) to (5). The testing results and the amount of solids coated per side (per side coverage) are shown in Table 1.

| Coating Composition XI: | |
|---|---|
| Synthetic silica [Finesil, trade name, a product of Tokuyama Soda Co. Ltd.] | 100 parts |
| Binder [PVA 105 (trade name, a product of Kuraray Co., Ltd.), polymerization degree: 500] | 5 parts |
| Sizing agent [Basoplast 250D, trade name, a product of Basof Co., Ltd.] | 30 parts |
| Anti-foaming agent [Foamaster AP, trade name, a product of San Nopco Co., Ltd.] | 0.05 part |

Additionally, the names and polymerization degrees of PVA products used in Examples and Comparative Examples, the amounts used therein, as well as the Runkel ratios of the pulp used together therewith are set forth together in Table 2.

TABLE 1

| | Coverage Rate (g/cm$^2$)*1 | Contact Angle*2 | Optical Density of Recorded Image | Feathering | White Spots in Solid Area | Bleeding (μm) |
|---|---|---|---|---|---|---|
| Example 1 | 2.70 | 95 | 1.24 | ○ | ○ | 80 |
| Example 2 | 4.10 | 87 | 1.30 | ○ | ○ | 40 |
| Example 3 | 2.80 | 97 | 1.32 | ○ | Δ | 180 |
| Example 4 | 3.20 | 92 | 1.26 | ⊙ | ○ | 40 |
| Example 5 | 1.80 | 93 | 1.22 | ○ | ○ | 30 |
| Example 6 | 0.80 | 90 | 1.28 | ○ | Δ | 60 |
| Compar. Ex. 1 | 2.80 | 92 | 1.25 | ○ | X | 350 |
| Compar. Ex. 2 | 4.00 | 88 | 1.28 | ○ | X | 300 |
| Compar. Ex. 3 | 3.50 | 48 | 1.16 | X | ○ | 20 |
| Compar. Ex. 4 | 1.90 | 89 | 1.07 | ○ | ○ | 40 |
| Compar. Ex. 5 | 1.00 | 91 | 1.27 | ○ | X | 300 |
| Compar. Ex. 6 | 2.00 | 108 | 1.20 | ○ | X | 380 |

*1Amount of solids per side.
*2Contact angle with solution of surface tension of 40 dyne/cm.

TABLE 2

| | Species of PVA | Polymerization Degree of PVA | Amount mixed parts by weight |
|---|---|---|---|
| Example 1 | PVA 105 | 500 | 15 |
| Example 2 | PVA 103 | 300 | 30 |
| Example 3 | PVA 110 | 1,000 | 10 |
| Example 4 | PVA 105 | 500 | 15 |
| Example 5 | PVA 105 | 500 | 15 |
| Example 6 | PVA 103 | 300 | 15 |
| Compar. Ex. 1 | PVA 117 | 1,700 | 15 |
| Compar. Ex. 2 | PVA 120 | 2,000 | 15 |
| Compar. Ex. 3 | PVA 103 | 300 | 30 |
| Compar. Ex. 4 | PVA 105 | 500 | 10 |
| Compar. Ex. 5 | PVA 105 | 500 | 5 |
| | PVA 117 | 1,700 | 10 |
| Compar. Ex. 6 | PVA 105 | 500 | 15 |

Example 7

Pulp slurry was prepared by mixing 50 parts of L-BKP manufactured from eucalyptus of Newcastle (Australia) growth (Runkel ratio: 2.35) with 50 parts of L-BKP manufactured from eucalyptus of Tasmania growth (Runkel ratio: 0.66) and beating them so as to have a freeness of 500 ml (C.S.F). To the pulp slurry thus prepared, ground calcium carbonate, 1.0 part of aluminum sulfate, 1 part of cationized starch, 0.1 part of a sizing agent (alkylketene dimer) and 0.02 part of a retention aid were added to prepare a paper stock. This paper stock was made into paper by means of a Fourdrinier paper machine so that the resulting paper had a basis weight of 78 g/m$^2$ and a filler content of 5.8% Then, the thus made paper was coated on both sides with the following coating composition XII by means of a size press.

| Coating Composition XII: | |
|---|---|
| Synthetic silica [Finesil, trade name, a product of Tokuyama Soda Co. Ltd.] | 100 parts |
| Binder [PVA 117, trade name, a product of Kuraray Co., Ltd.] | 20 parts |
| Sizing agent [Basoplast 250D, trade name, a product of Basof Co., Ltd.] | 10 parts |
| Anti-foaming agent [Foamaster AP, trade name, a product of San Nopco Co., Ltd.] | 0.05 part |

Example 8

To pulp slurry prepared by mixing 70 parts of L-BKP manufactured from acacia of South Africa growth (Runkel ratio: 1.49) with 30 parts of L-BKP manufactured from wood of Hokkaido growth (Runkel ratio: 0.66) and beating them so as to have a freeness of 450 ml (C.S.F) were added the same internal additives in the same respective amounts as in Example 7 to prepare a paper stock. This paper stock was made into paper by means of a Fourdrinier paper machine so that the resulting paper had a basis weight of 61 g/m$^2$ and a filler content of 7.5% Then, the thus made paper was coated on both sides with the following coating composition XIII by means of a gate roll coater.

| Coating Composition XIII: | |
|---|---|
| Synthetic silica [Mizukasil, trade name, a product of Mizusawa Kagaku Co. Ltd.] | 100 parts |
| Binder [PVA 117, trade name, a product of Kuraray Co., Ltd.] | 10 parts |

-continued

| Coating Composition XIII: | |
|---|---|
| Sizing agent [NC Size C-40, trade name, a product of Nikka Kagaku Co., Ltd.] | 12 parts |
| Anti-foaming agent [Foamaster AP, trade name, a product of San Nopco Co., Ltd.] | 0.05 part |

Example 9

To pulp slurry prepared by mixing 50 parts of L-BKP manufactured from eucalyptus of Newcastle (Australia) growth (Runkel ratio: 2.35) with 50 parts of L-BKP manufactured from acacia of South Africa growth (Runkel ratio: 1.49) and beating them so as to have a freeness of 520 ml (C.S.F) were added the same internal additives in the same respective amounts as in Example 7 to prepare a paper stock. This paper stock was made into paper by means of a Fourdrinier paper machine so that the resulting paper had a basis weight of 125 g/m$^2$ and a filler content of 3.2% Then, the thus made paper was coated on both sides with the following coating composition XIV by means of a size press.

| Coating Composition XIV: | |
|---|---|
| Synthetic silica [Aerozil, trade name, a product of Nippon Aerozil Co. Ltd.] | 100 parts |
| Binder [PVA 105, trade name, a product of Kuraray Co., Ltd.] | 10 parts |
| Sizing agent [BLS-720, trade name, a product of Misawa Ceramics Co., Ltd.] | 10 parts |
| Anti-foaming agent [Foamaster AP, trade name, a product of San Nopco Co., Ltd.] | 0.05 part |

Comparative Example 7

To pulp slurry prepared by beating 100 parts of L-BKP manufactured from eucalyptus of Tasmania growth (Runkel ratio: 0.66) so as to have a freeness of 500 ml (C.S.F) were added the same internal additives in the same respective amounts as in Example 7 to prepare a paper stock. This paper stock was made into paper by means of a Fourdrinier paper machine so that the resulting paper had a basis weight of 78 g/m$^2$ and a filler content of 5.5% Then, the thus made paper was coated on both sides with the foregoing coating composition XII by means of a size press.

Comparative Example 8

To pulp slurry prepared by beating 100 parts of L-BKP manufactured from wood of Hokkaido growth (Runkel ratio: 0.46) so as to have a freeness of 400 ml (C.S.F) were added the same internal additives in the same respective amounts as in Example 7 to prepare a paper stock. This paper stock was made into paper by means of a Fourdrinier paper machine so that the resulting paper had a basis weight of 61 g/m$^2$ and a filler content of 7.5% Then, the thus made paper was coated on both sides with the foregoing coating composition XIII by means of a gate roll coater.

Comparative Example 9

A paper stock was prepared in the same manner as in Example 9, and made into paper by means of a Fourdrinier paper machine so that the resulting paper had a basis weight of 125 g/m$^2$ and a filler content of 3.3% Then, the thus made paper was coated on both sides with the following coating composition XV by means of a size press.

| Coating Composition XV | |
|---|---|
| Synthetic silica [Aerozil, trade name, a product of Nippon Aerozil Co. Ltd.] | 100 parts |
| Binder [PVA 105, trade name, a product of Kuraray Co., Ltd.] | 10 parts |
| Anti-foaming agent [Foamaster AP, trade name, a product of San Nopco Co., Ltd.] | 0.05 part |

Comparative Example 10

To pulp slurry prepared by beating 100 parts of L-BKP manufactured from eucalyptus of Tasmania growth (Runkel ratio: 0.66) so as to have a freeness of 400 ml (C.S.F) were added the same internal additives in the same respective amounts as in Example 7 to prepare a paper stock. This paper stock was made into paper by means of a Fourdrinier paper machine so that the resulting paper had a basis weight of 78 g/m$^2$ and a filler content of 5.5% Then, the thus made paper was coated on both sides with the following coating composition XVI by means of a size press.

| Coating Composition XVI: | |
|---|---|
| Synthetic silica [Finesil, trade name, a product of Tokuyama Soda Co. Ltd.] | 100 parts |
| Binder [PVA 117 , trade name, a product of Kuraray Co., Ltd.] | 20 parts |
| Sizing agent [BLS-720, trade name, a product of Misawa Ceramics Co., Ltd.] | 10 parts |
| Anti-foaming agent [Foamaster AP, trade name, a product of San Nopco Co., Ltd.] | 0.05 part |

Comparative Example 11

To pulp slurry prepared by mixing 70 parts of L-BKP manufactured from mangrove of Indonesia growth (Runkel ratio: 3.35) with 30 parts of L-BKP manufactured from eucalyptus of Tasmania growth (Runkel ratio: 0.66) and beating them so as to have a freeness of 500 ml (C.S.F) were added the same internal additives in the same respective amounts as in Example 7 to prepare a paper stock. This paper stock was made into paper by means of a Fourdrinier paper machine so that the resulting paper had a basis weight of 78 g/m$^2$ and a filler content of 5.6% Then, the thus made paper was coated on both sides with the foregoing coating composition XII by means of a size press.

Example 10

A paper stock was prepared in the same manner as in Example 7 and made into paper by means of a Fourdrinier paper machine so that the paper had a basis weight of 78 g/m$^2$ and a filler content of 5.2%. The paper thus made was coated on both sides with a 3% solution of oxidized starch by means of a size press.

Further, the thus sized paper was coated on one side with the foregoing coating composition XII and on the other side with a 3% solution of PVA 105 for prevention of curling by means of a Mayor bar coater.

In Table 3, the species, the Runkel ratios, the mixing ratios and the freeness values of pulps used in Examples 7 to 10 and Comparative Examples 7 to 11 are set forth together.

Further, the amount of solids coated per side (per side coverage) in each of Examples 7 to 10 and Comparative Examples 7 to 11, and the testing results obtained in each Example and each Comparative Example, including the contact angle, the optical density of recorded image, the spread of ink, the drying time of ink and bleeding, are shown together in Table 4.

TABLE 3

| | Species of Wood | Runkel Ratio | Amount mixed | Freeness (ml) |
|---|---|---|---|---|
| Example 7 | Eucalyptus of Australia Growth | 2.35 | 50 | 500 |
| | Eucalyptus of Tasmania Growth | 0.66 | 50 | |
| Example 8 | Acacia of South Africa Growth | 1.49 | 70 | 450 |
| | Wood of Hokkaido Growth | 0.46 | 30 | |
| Example 9 | Eucalyptus of Australia Growth | 2.35 | 50 | 520 |
| | Acacia of South Africa Growth | 1.49 | 50 | |
| Example 10 | Eucalyptus of Australia Growth | 2.35 | 50 | 500 |
| | Eucalyptus of Tasmania Growth | 0.66 | 50 | |
| Compar. Ex. 7 | Eucalyptus of Tasmania Growth | 0.66 | 100 | 500 |
| Compar. Ex. 8 | Wood of Hokkaido Growth | 0.46 | 100 | 400 |
| Compar. Ex. 9 | Eucalyptus of Australia Growth | 2.35 | 50 | 520 |
| | Acacia of South Africa Growth | 1.49 | 50 | |
| Compar. Ex. 10 | Eucalyptus of Tasmania Growth | 0..66 | 100 | |
| Compar. Ex. 11 | Mangrove of Indonesia Growth | 3.35 | 70 | 500 |
| | Eucalyptus of Tasmania Growth | 0.66 | 30 | |

TABLE 4

| | Coverage Rate (g/cm$^2$) | Contact Angle*2 | Optical Density of Recorded Image | Feathering | Drying Time of Ink (sec) | Bleeding ($\mu$m) |
|---|---|---|---|---|---|---|
| Example 7 | 2.70 | 95 | 1.24 | ○ | 8 | 80 |
| Example 8 | 4.10 | 87 | 1.30 | ○ | 5 | 40 |
| Example 9 | 0.80 | 97 | 1.22 | ○ | 10 | 180 |
| Example 10 | 2.00 | 89 | 1.32 | ○ | 4 | 30 |
| Compar. Ex. 7 | 2.80 | 92 | 1.25 | ○ | 18 | 350 |
| Compar. Ex. 8 | 4.00 | 88 | 1.28 | ○ | 15 | 300 |
| Compar. Ex. 9 | 0.90 | 48 | 1.16 | X | 4 | 20 |

TABLE 4-continued

| | Coverage Rate ($g/cm^2$) | Contact Angle*2 | Optical Density of Recorded Image | Feathering | Drying Time of Ink (sec) | Bleeding ($\mu m$) |
|---|---|---|---|---|---|---|
| Compar. Ex. 10 | 2.30 | 112 | 1.18 | ○ | 32 | 600 |
| Compar. Ex. 11 | 3.20 | 91 | 1.26 | X~Δ | 3 | 20 |

*1Amount of solids coated per side.
*2Contact angle with solution having surface tension of 40 dyne/cm.

What is claimed is:

1. An ink jet recording paper having an ink receiving layer comprising a high absorption pigment and a binder provided on at least one side of a base paper comprising wood pulp and a filler, said ink receiving layer having a coverage rate of from 0.5 to 5.0 $g/m^2$ per side of the base paper and a contact angle of from 80 to 100 degrees measured within 0.1 second after dropping a liquid having a surface tension of 40 dyne/cm, on the ink receiving layer, wherein the wood pulp comprises at least 20% of L-BKP having the Runkel ratio of from 1.0 to 3.0.

2. An ink jet recording paper according to claim 1, wherein the amount of filler in the base paper is no greater than 10 weight parts per 100 weight parts of wood pulp.

3. An ink jet recording paper according to claim 2, wherein the total wood pulp in the base has an average freeness of from 450 to 600 ml C.S.F.

4. An ink jet recording paper according to claim 3, wherein the proportion of the binder in the ink receiving layer is from 5 to 25 parts by weight per 100 parts by weight of pigment.

5. An ink jet recording paper according to claim 2, wherein the proportion of the binder in the ink receiving layer is from 5 to 25 parts by weight per 100 parts by weight of pigment.

6. An ink jet recording paper according to claim 1, wherein the wood pulp comprises at least 70% L-BKP.

7. An ink jet recording paper according to claim 1, wherein the total wood pulp in the base has an average freeness of from 450 to 600 ml C.S.F.

8. An ink jet recording paper having an ink receiving layer comprising a high absorption pigment and a binder provided on at least one side of a base paper comprising wood pulp and a filler, said ink receiving layer having a coverage rate of from 0.5 to 5.0 $g/m^2$ per side of the base paper and a contact angle of from 80 to 100 degrees measured within 0.1 second after dropping a liquid having a surface tension of 40 dyne/cm, on the ink receiving layer, wherein the wood pulp comprises at least 20% of L-BKP having the Runkel ratio of from 1.0 to 3.0, wherein at least 70 weight % of the total binder in the ink receiving layer is polyvinyl alcohol and at least 50 weight % of the polyvinyl alcohol has a polymerization degree of from 300 to 1,000.

9. An ink jet recording paper according to claim 8, wherein the proportion of the binder in the ink receiving layer is from 5 to 25 parts by weight per 100 parts by weight of pigment.

* * * * *